US007255183B2

(12) United States Patent
Cramer

(10) Patent No.: US 7,255,183 B2
(45) Date of Patent: Aug. 14, 2007

(54) GAP SUB ASSEMBLY

(75) Inventor: David Cramer, Okotoks (CA)

(73) Assignee: Phoenix Technology Services, LP, Calgary, Alberta (CA)

( * ) Notice: Subject to any disclaimer, the term of this patent is extended or adjusted under 35 U.S.C. 154(b) by 251 days.

(21) Appl. No.: 11/074,009

(22) Filed: Mar. 8, 2005

(65) Prior Publication Data

US 2006/0201717 A1 Sep. 14, 2006

(51) Int. Cl.
*E21B 17/02* (2006.01)

(52) U.S. Cl. ..... 175/320; 166/242.6; 166/65.1

(58) Field of Classification Search ..... 166/242.1, 166/242.6, 65.1; 175/320; 411/178, 265
See application file for complete search history.

(56) References Cited

U.S. PATENT DOCUMENTS 2,388,141 A * 10/1945 Harrington ..... 175/50
2,622,124 A * 12/1952 Homer ..... 324/351
4,496,174 A * 1/1985 McDonald et al. ..... 285/53
4,589,187 A * 5/1986 Stone et al. ..... 29/458
5,138,313 A * 8/1992 Barrington ..... 340/854.6
5,396,232 A * 3/1995 Mathieu et al. ..... 340/854.5
5,783,039 A * 7/1998 Murayama ..... 162/146
7,080,699 B2 * 7/2006 Lovell et al. ..... 175/40
2004/0206510 A1 * 10/2004 Fraser et al. ..... 166/378

* cited by examiner

*Primary Examiner*—Kenneth Thompson
(74) *Attorney, Agent, or Firm*—Millen, White, Zelano & Branigan, P.C.

(57) ABSTRACT

The gap sub assembly comprises a pair of electrically conductive subs. Each sub has a threaded pin and box. A pin and box are threaded together to form a connection. An electrically insulating, woven fabric overlies and conforms with the threads of the connection pin. An electrically insulating, annular washer separates the seal faces of the connection. The assembly functions to provide an electrical discontinuity when incorporated into a conductive drill string.

9 Claims, 2 Drawing Sheets

GAP SUB ASSEMBLY

FIELD OF THE INVENTION

The present invention relates to an electrically insulating gap sub assembly for use in a drill string. The gap sub assembly functions to block current flow through the drill string.

BACKGROUND OF THE INVENTION

It is known in oilfield drilling technology to provide an assembly, at the lower end of a drill string drilling a wellbore, for transmitting downhole data, measured by sensors, to a receiver at ground surface. This transmission is done by means of electric signals passing upwardly through the formation penetrated by the wellbore.

For example, it is known to measure the inclination and direction of the wellbore adjacent the bit using an EMT tool. The EMT tool includes a signal generating unit spaced behind the drill bit. This unit produces alternating current signals indicative of the measurements taken by downhole sensors.

In conjunction with the signal generating unit it is necessary to provide, in the drill string, a device that will block current flow through the conductive steel pipe of the drill string, to thereby induce the current flow to move upwardly to ground surface through the formations penetrated by the wellbore.

One known device in use for this purpose is commonly referred to as a 'gap sub assembly'.

The gap sub assembly comprises a pair of tubular pipe subs threadably connected end to end by a pin and box connection. A 'sub' is industry terminology for a short length of pipe having threaded pin and box ends. A pin and box are threaded together to form a 'connection' joining the two subs end to end. The sub also usually has a shoulder, at the pin root, forming an annular face. In such a case, the box used forms an annular end face. These faces are provided to press together and seal when the connection is 'made up', thereby preventing the egress of drilling fluid into the well annulus.

Heretofore, commercially used gap sub assemblies have usually involved applying a coating of dielectric material, such as ceramic or the material identified by the trade-mark TEFLON™, and bonding it onto the threads of the pin and the end faces of the connection. In this way an electrically insulated gap is provided. When the gap sub assembly is incorporated into the electrically conductive drill string, the gap serves to block current flow along the string.

However, these known gap sub assemblies have shortcomings. The assemblies are subject to severe compressive and tensile stresses in use. The brittle ceramic coatings tend to crack and chip, thereby leading to loss of the electric discontinuity. And the Teflon™ coating may extrude during use, leading to the same result.

There therefore exists a need for a durable and relatively inexpensive gap sub assembly.

SUMMARY OF THE INVENTION

In accordance with one preferred embodiment of the invention, an electrically insulating gap sub assembly is provided, comprising:

- a pair of tubular steel subs, each sub having a threaded pin and box at its ends, each pin and box preferably having a seal face;
- the pin of one sub being threaded into the box of the other sub to form a connection which joins the subs end to end;
- a layer of electrically insulating, woven fabric wrapping and conforming with the threads of the connection pin; and
- an annular washer of electrically insulating material, positioned between the seal faces.

Preferably, the woven fabric is formed of poly(p-phenyleneterephtalamide), a material which is sold commercially under the registered trade-mark KEVLAR™. Such fabric has been shown to be capable of withstanding the make-up torque applied when threading together the two subs. It also has been shown to withstand the tensional and compressive stresses which arise when incorporated into an operational drill string. And finally, it is effective to provide electrical discontinuity.

In the preferred case where the sub connection pin and box have annular seal faces, an electrically insulating washer is provided between the faces. The washer, preferably formed of ceramic, is adapted to withstand compressive loading applied by the two seal faces when the gap sub assembly is made up and incorporated into the operational drill string.

In one embodiment, the invention is directed to an electrically insulating gap sub assembly for use in a drill string, comprising: tubular first and second subs, each sub having a threaded pin and box, the subs being connected end to end by a pin and box connection; and a layer of electrically insulating, woven fabric wrapping and conforming with the threads of the connection pin, so that the fabric layer electrically isolates one sub from the other by blocking current flow therebetween.

DESCRIPTION OF THE PREFERRED EMBODIMENT

Figure 1:
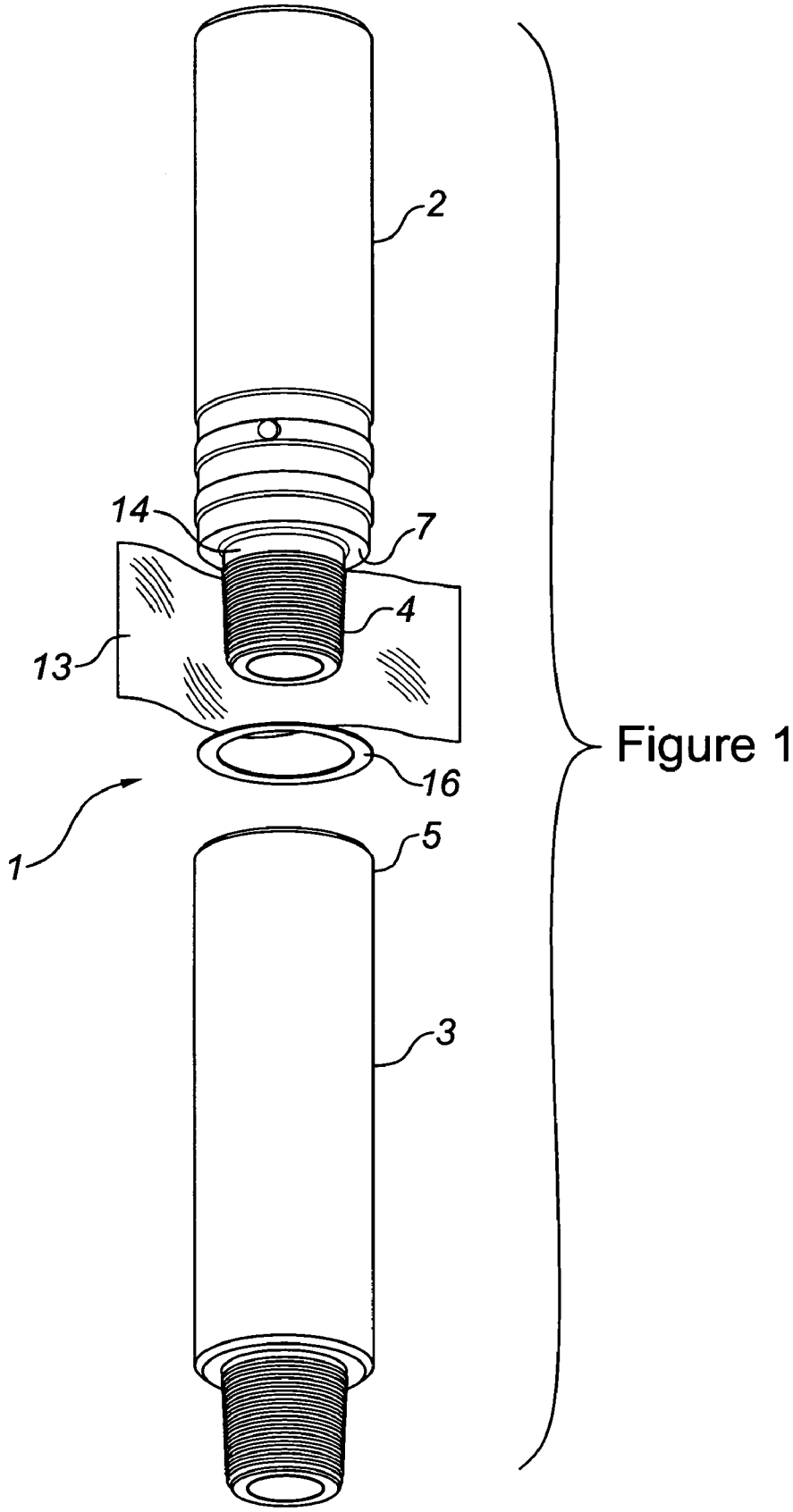
FIG. 1 is a perspective exploded view of a gap sub assembly in accordance with the preferred embodiment.
Figure 2:
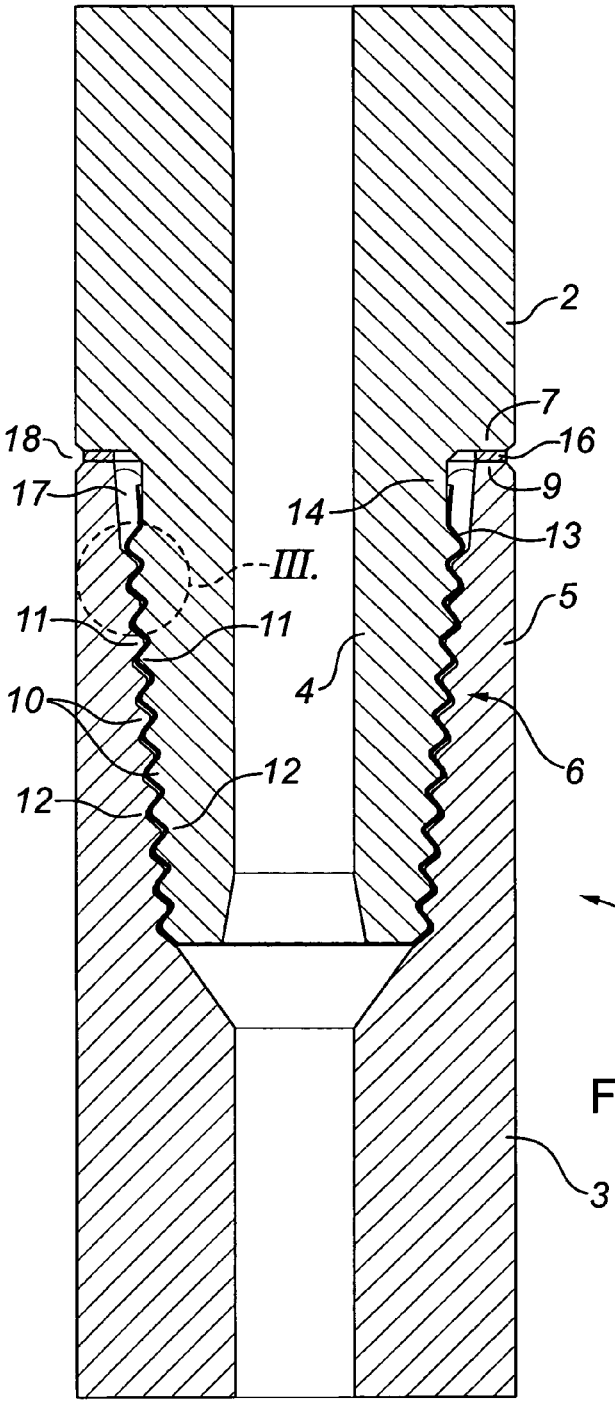
FIG. 2 is a side sectional view showing the connection of the gap sub assembly of FIG. 1, in a made up condition.
Figure 3:
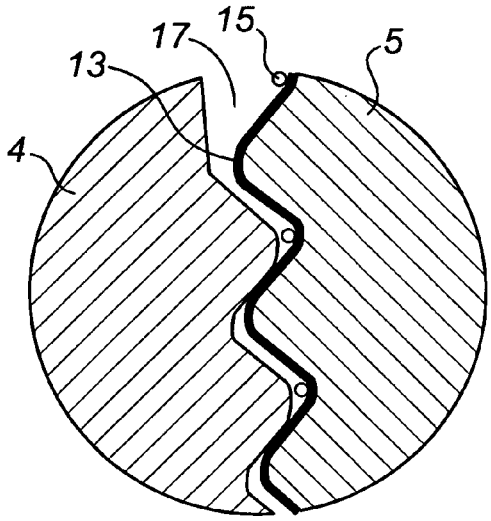
FIG. 3 is an expanded view of the circled portion of FIG. 2.

Having reference to the Figures, there is provided a gap sub assembly 1 comprising a pair of tubular, steel pipe subs 2,3. Each sub 2,3 has a threaded pin 4 and box 5 at its ends. When assembled, the pin 4 of one sub 2 is threadably connected with the box 5 of the other sub 3 to form a connection 6 joining the subs end to end. At the connection 6, the sub 2 has a shoulder 7 forming an annular face 8 and the box 5 of the sub 3 has an annular end face 9.

The pin 4 and box 5 of each sub 2,3 are machined to form tapered threads 10, such as Hughes H-90™ threads, having crests 11 and trough 12. The connection pin 4 is machined to standard dimensions. The connection box 5 is machined slightly oversize to allow room for the layer 13 of KEVLAR™ woven fabric. Cutting the connection box threads 0.007" deeper for a 0.005" thick fabric layer 13, is suitable.

The fabric layer 13 is dimensioned to completely cover the connection pin threads 10 with minimal overlap. The fabric layer 13 is sized to extend onto the pin root 14. A cord 15, such as dental floss or fishing line, is secured around the fabric layer 13, so as to cause the latter to conform snugly with the thread crests 11 and troughs 12.

An annular, electrically insulating ceramic washer 16, available from Dynamic Ceramic, Calgary, under the trademark TECHNOX™, is positioned so as to contact and separate the connection pin face 8 and connection box end face 9. The washer 16 has a thickness of 0.070".

A coating 17 of a sealing compound, such as SCOTCH WELD™ epoxy and hardener, available from 3M, is applied over the fabric layer 13 and washer 16, to prevent intrusion of drilling fluid between the threads 10.

The subs 2,3 are screwed together and chain tongs are used to apply about 500 ft-lbs of torque. The two sub faces 8,9 should come to within about ⅛" of facing up if the threads 10 are properly cut.

The electrical resistance across the gap 18 is then tested using an ohm-meter. It should read at least 1 Mohm.

The subs 2,3 are then screwed further together, to apply about 5000 ft-lbs of torque in the case of 3¾" diameter subs. At about 2000 ft-lbs, the connection components should face together. The assembly 1 should then again be tested for resistance across the gap 18. The ohm-meter should read more than 1 Mohm.

The foregoing description is directed to one specific preferred embodiment of the invention. It is anticipated that other suitable, electrically insulating, woven fabrics may be identified by one skilled in the art and substituted for the KEVLAR fabric. Furthermore, another suitable, electrically insulating, compression-resistant material may be identified and substituted for the ceramic washer. It is intended that the scope of the invention is defined by the appended claims.

The embodiment of the invention in which an exclusive property or privilege is claimed are defined as follows:

1. An electrically insulating gap sub assembly for use in a drill string, comprising:

tubular first and second subs, each having a threaded pin and box, the subs being connected end to end by a pin and box connection; and a layer of electrically insulating, woven fabric wrapping and conforming with the threads of the connection pin, so that the fabric layer electrically isolates one sub from the other by blocking current flow therebetween.

2. The gap sub assembly as set forth in claim 1 wherein:

the connection pin and box each have an annular seal face; and comprising:

an electrically insulating annular washer positioned between the seal faces for blocking current flow therebetween and being adapted to withstand the compressive loading experienced when used in an operational drill string.

3. The gap sub assembly as set forth in claim 1 wherein:

the woven fabric is formed of poly (p-phenyleneterephtalamide).

4. The gap sub assembly as set forth in claim 2 wherein:

the washer is formed of ceramic.

5. The gap sub assembly as set forth in claim 2 wherein:

the fabric layer and washer are coated with epoxy to seal against drilling fluid ingress.

6. The gap sub assembly as set forth in claim 2 wherein:

the woven fabric is formed of poly (p-phenyleneterephtalamide).

7. The gap sub assembly as set forth in claim 3 wherein:

the washer is formed of ceramic.

8. The gap sub assembly as set forth in claim 3 wherein:

the fabric layer and washer are coated with epoxy to seal against drilling fluid ingress.

9. The gap sub assembly as set forth in claim 4 wherein:

the fabric layer and washer are coated with epoxy to seal against drilling fluid ingress.

* * * * *